United States Patent [19]

Podd

[11] 4,186,845

[45] Feb. 5, 1980

[54] CONTAINER LINER

[76] Inventor: Victor T. Podd, 255 Beverly Ave., Montreal, Quebec, Canada

[21] Appl. No.: 929,964

[22] Filed: Aug. 1, 1978

[51] Int. Cl.[2] ..... B65D 25/14; B65D 25/16

[52] U.S. Cl. ..... 220/461; 206/524.2; 220/902; 296/39 R; 428/78; 428/126; 428/159

[58] Field of Search ..... 296/39 R, 39 A; 220/461, 460, 403, 452; 206/524.2; 150/1, 52 F; 428/159, 126, 78

[56] References Cited

U.S. PATENT DOCUMENTS

| | | | |
|---|---|---|---|
| 857,435 | 6/1907 | Bell | 206/521 X |
| 2,317,651 | 4/1943 | Talbot | 220/403 |
| 2,832,964 | 5/1958 | Sebreny | 220/452 X |
| 2,911,253 | 11/1959 | Dewey | 296/39 R |
| 3,412,521 | 11/1968 | Bauman | 206/523 X |
| 3,537,116 | 11/1970 | Kain | 428/159 X |
| 3,741,844 | 6/1973 | Schwartz | 156/244.11 |
| 3,904,084 | 9/1975 | Ukmar et al. | 220/460 X |
| 4,011,798 | 3/1977 | Bambara et al. | 206/523 X |

FOREIGN PATENT DOCUMENTS

| | | | |
|---|---|---|---|
| 1439762 | 4/1966 | France | 296/39 R |

*Primary Examiner*—Allan N. Shoap
*Attorney, Agent, or Firm*—Alan Swabey; Robert E. Mitchell; Guy J. Houle

[57] ABSTRACT

The present invention relates to a liquid impervious liner securable in a shipping container for use in the shipping of material which can contaminate or corrode the container or the environment. The liner comprises a base sheet of foam material and a top cover sheet of polymeric material which is bonded to the base sheet and which extends over at least a portion of the walls of the container whereby to substantially constitute a tub which is liquid impervious. A typical use of these liners is for the transportation and shipping of raw skins of animals which are normally treated with rock salt before treatment by tanneries.

7 Claims, 5 Drawing Figures

CONTAINER LINER

BACKGROUND OF INVENTION (a) Field of the Invention

The present invention relates to a liquid impervious liner for use in shipping containers and which is easily insertable and removable from such containers.

The liquid impervious liner of the present invention is particularly, although not exclusively, suitable for the transportation of rawhides which are shipped in various type containers, such as trailers, railroad cars, box containers, etc. These raw animal skins are shipped all over the world to be treated to make leather for use in the manufacture of leather products. In the shipping of these hides, they are normally interleaved with rock salt and a great deal of liquid is secreted from the hides in the form of amino acids. These amino acids, in combination with the rock salt, have created disastrous results to the equipment being used to transport the hides. For example, the acids and the salt will create corrosion to the container and eventually render the container irreparable. Further, during transportation and handling, the liquids are sometimes spilled or leak from the containers and contaminate the environment, such as roads, shipping docks, ships, etc.

(b) Description of Prior Art

Known methods utilized today to solve this problem are proving unsatisfactory and costly. The most commonly used liner known is an extruded polyethylene sheet having a diameter of approximately 18 feet and a length of anywhere from 20 to 45 feet, depending on the length of the container or railcar. This tube-type polyethylene sheet is gathered and crimped at one end and tied together with a piece of wire to give a sausage-skin type appearance. It is then placed with the tied end into the front of a container.

The hides, which normally come on wooden pallets, are placed with an average height of 2 to 3 feet inside the polyethylene sheet which is now inside the container and is loaded until the pallets fill the whole length of the container. The hides, which are normally no more than 3 feet in height, would weigh approximately 40,000 lbs. in a 30 or 35 foot container. It can be seen that loading such a bag in a container is a difficult task.

The major problem with this method is that in the majority of cases the polyethylene sheets are punctured, either as a result of negligent driving of a lift trucks's sharp edges on the pallets, or protruding objects in the container itself such as nails, screws, or even splinters of wood. As a result of these punctures, the amino acids combined with the rock salt, ooze out of the liners thereby corroding the containers or the vehicle used for the transporation of these liners.

In addition to the corrosion factor created by the liquid is the smell and the stench caused by shipping raw hide liners. Upon arrival the smell remains inside the container making it very difficult to ship other commodities as a result of the odours.

Another serious problem as a result of a leaky liner is that it also creates leaky containers and therefore creates a health hazard by having these liquids dispersed on highways, docks, and factories with the spread of bacteria and other harmful microorganisms.

A special container was also developed which is extremely costly and consists of stainless steel floors which are ribbed and underneath these floors is a special catch-basin also fabricated from stainless steel with special taps for the release of the liquids when desired. The drawback to this type of container is its extreme high cost plus the fact that it is limited to the shipment of raw hides only and in many cases containers go back empty. This is a costly solution.

SUMMARY OF INVENTION

It is a feature of the present invention to provide a liquid impervious liner which substantially overcomes the above-mentioned disadvantages of the prior art.

A further feature of the present invention is to provide a liquid impervious liner which is easy to install in a container and which is substantially leakproof.

A further feature of the present invention is to provide a liquid impervious liner which will prevent leakage even when a top cover sheet of the bottom wall is punctured.

According to the above features, from a broad aspect, the present invention provides a liquid impervious liner for use in shipping containers, the liner comprising a base sheet of foam-like material and a top cover sheet of polymeric material bonded to the base sheet and having panel portions extending beyond the peripheral edge of the base sheet.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
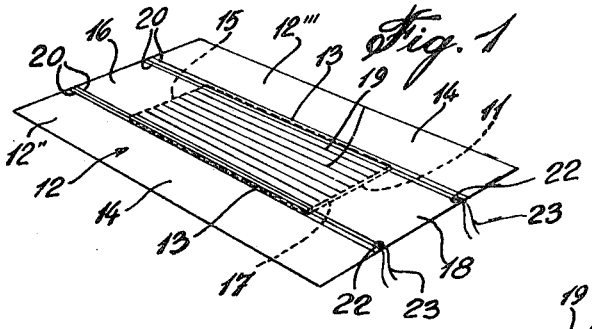
FIG. 1 is a perspective view of the liquid impervious liner of the present invention.
Figure 2:
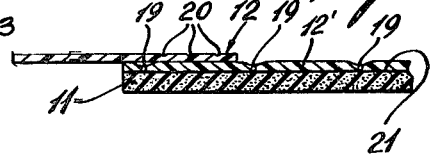
FIG. 2 is a fragmented section view showing the construction of the liquid impervious liner.

Referring now to the drawings, and more particularly to FIGS. 1 and 2, there is shown generally at 10, the liquid impervious liner of the present invention. The liner comprises a base sheet 11 of foam-like material and, for example, a closed-cell foam or any other suitable material which is liquid impervious and which is shock absorbing. A top cover sheet 12 of polymeric material such as polyethylene, is bonded to the base sheet 11 and extends beyond the periphery of the base sheet.

As hereinshown, the base sheet and top cover sheet are of rectangular shape with the top cover sheet being, of course, larger than the base sheet to form panel portions. The portions extending beyond the side edges 13 of the base sheet 11 constitute side panels 14. The portion extending beyond the front edge 15 of the base sheet 11 constitutes a front panel 16. The portion extending beyond the rear edge 17 of the base sheet 11 constitutes the rear panel 18 of the liner.

As shown in FIG. 2, the top cover sheet 12 is constituted by three rectangular sheet sections. A first sheet section 12' is bonded to the base sheet 11 by a plurality of heat-sealed strips 19 equidistantly spaced and extending along the entire length of the base sheet 11 (see FIG. 1). A second and a third sheet of polyethylene material 12" and 12"' respectively overlaps the first sheet 12' at the respective side edge portion thereof and heat sealed to the first sheet 12' by a plurality, herein three, of closely spaced continuous heat sealed strips 20. Thus, it can be seen that in the side edge portions of the base sheet 11, a plurality of seals are provided whereby if the top cover sheet 12 is punctured, any liquid flowing thereunder would be trapped between the seals 20 and 19 onto the top surface 21 of the base sheet 11.

As shown in FIG. 1, eyelets 22 are provided in respective outer corners of the rear panel 18. Securement means in the form of straps or ropes 23 are attached to the eyelets for a purpose which will be described later.

A typical specification of the liner illustrated herein may be constituted by a base sheet of closed cell foam of ¼" thickness and a top cover sheet constituted by high density polyethylene material of a thickness of 20 mil. The heat sealed strips may be formed by a long heating element whereby a continuous uninterrupted bond is effected longitudinally of the bottom and top cover sheets. The base sheet 11 may also be constituted by a polyfoam-type rubber that is normally used as an underpadding for carpets and this base sheet 11 is sized to cover the floor area of a container. A further top sheet of polyethylene may be heat sealed over the polyethylene sheet 12 and over base sheet area only. This further top sheet may also be of linoleum and have a shiny or slippery surface which would prevent tearing of the polyethylene and other films. However, the liner structure shown in FIG. 1 has been found suitable without this added sheet.

The purpose of the rubberized foam base sheet is to absorb some of the shock created when loading and unloading material onto the base sheet and also protects the polyethylene from being punctured as it will prevent vertical downward displacement of the polyethylene.

Figure 3:
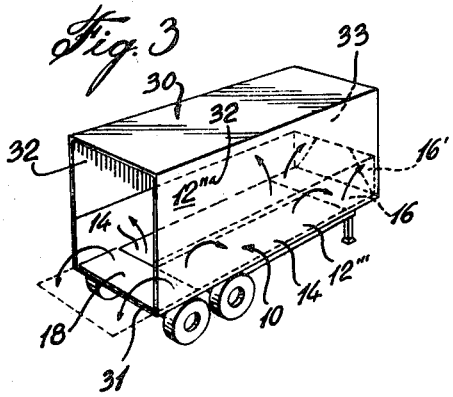
FIG. 3 is a perspective view showing the installation of the liquid impervious liner in a container.
Figure 4:
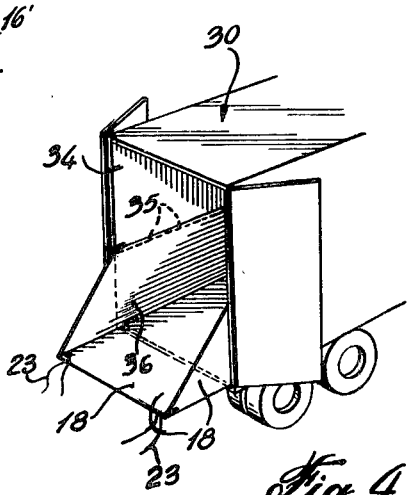
FIG. 4 is a perspective view of an end section of a container showing the manner in which the rear panel is located with respect to the container.
Figure 5:
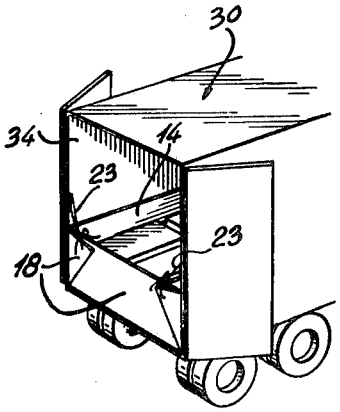
FIG. 5 is a perspective view of an end section of the container showing the manner in which the rear panel of the liner is secured across a container opening.

Referring now to FIGS. 3 to 5, there is shown the manner in which the liner is positioned and secured in a container, such as a trailer 30. The trailer 30 is substantially a rectangular box container and has a bottom wall 31, side walls 32, a front wall 33, and a closable open rear wall 34. The liner 10 is usually rolled up and inserted in the container 30 and unrolled over the bottom wall 31 with the base sheet 11 resting directly on the bottom wall 31. The liner is then in its unrolled folded state with the side panels 14 and the front and rear panels 16 and 18 respectively lying flat, as shown in FIG. 3. The side panels 14 and front panel 16 are then unfolded upwards and secured to the side walls and front wall of the container by securement means, such as staples 35, see FIG. 4. The rear panel 18 is retained upstanding, see FIG. 5, by attaching the straps or ropes 23 to suitable vertical rear edge portions of the side walls 34 of the container. Pleats 16' and 18' are made in the corners of the front and rear panels 16 and 18 by overlapping the material whereby these panels may be fastened to constitute rectangular panels and to provide liquid impervious corners. With the panels secured upstanding, the liner substantially constitutes a liquid impervious tub in the container to retain therein liquid secreted from the material being shipped, herein hides.

As shown in FIG. 4, the liner may also comprise an additional reinforcing strip 36 of polyethylene or other suitable reinforcing material in the rear portion of the rear edge 17 of the base sheet 11 and extending slightly over a bottom rear edge portion of the side panels 14. This is the area of the liner where there is more wear and tear when loading and unloading material in the container.

The liquid impervious liner of the present invention is particularly useful for the shipping of green salted raw hides and protects the container from contamination and corrosion. It also protects the container from offensive odours which would be retained therein should there be leakage of the liquids secreted from such hides. A further advantage of the liner of the present invention is that it can be installed in a trailer container by one man with a staple gun within approximately five minutes. The liners are prefabricated and form-fitted to the exact dimensions of a container and require no modifications in installation. The container being substantially leakproof prevents the spreading of bacteria and other micro-organisms on highways, in ports and on ships, during transportation of such materials.

It is within the ambit of the present invention to provide any obvious modifications thereof, provided such modifications fall within the definition of the invention as defined by the appended claims.

I claim:

1. A liquid impervious liner for use in shipping containers, said liner comprising a base sheet of cushioning material and a top cover sheet of polymeric material bonded to said base sheet by a plurality of spaced apart continuous seal strips extending entirely across said base sheet, said top cover sheet having panel portions extending beyond the periphery of said base sheet, said panel portions being portions of said top cover sheet extending beyond a front, rear and opposed side edges of said base sheet to constitute a front, rear and side panels, said top cover sheet being constituted by three rectangular sheets; a first of said sheets being bonded to said base sheet, which is also rectangular, by said plurality of seal strips and protruding beyond said front and rear edges of said base sheet to constitute said front and said rear panel; a second and third one of said sheets overlapping said first sheet at a respective side edge portion thereof and sealed thereto by a plurality of closely spaced continuous seal strips, said second and third sheets constituting said side panels.

2. A liner as claimed in claim 1 wherein said rear panel is provided with eyelets in respective outer corners thereof, and securement means attachable to said eyelets.

3. A liner as claimed in claim 1 wherein sad foam-like material is a closed cell foam material, said polymeric material being polyethylene material.

4. A liner as claimed in claim 3 wherein said base sheet has a thickness of ¼", said top cover sheet having a thickness of 20 mil and being a high density polyethylene.

5. A liner as claimed in claim 1 wherein said liner is secured in a rectangular box container having a bottom wall, side walls, a front wall and a closable opened rear wall, said base sheet extending over said bottom wall with said top cover sheet uppermost, said side panels being secured to said side walls, said front panel being secured to said front wall and pleated in the corners thereof, said rear panel being retained upstanding from said rear edge of said base sheet across from said side walls in said opened rear wall and pleated in the corners thereof, said liner constituting a substantially rectangular liquid impervious tub.

6. A liner as claimed in claim 5 wherein said rear panel is provided with eyelets in respective outer corners thereof, and securement means attachable to said eyelets and said container to retain said rear panel upstanding.

7. A liquid impervious liner for use in shipping containers, said liner comprising a base sheet of cushioning material and a top cover sheet of polymeric material bonded to said base sheet and having panel portions extending beyond the periphery of said base sheet, said panel portions being portions of said top cover sheet extending beyond a front, rear and opposed side edges of said base sheet to constitute a front, rear and side panels, said liner is secured in a rectangular box container having a bottom wall, side walls, a front wall and a closable opened rear wall, said base sheet extending over said bottom wall with said top cover sheet uppermost, said side panels being secured to said side walls, said front panel being secured to said front wall and pleated in the corners thereof, said rear panel being provided with eyelets in respective outer corners thereof, and strap-like members attachable to said eyelets and said container to retain said rear panel upstanding from said rear edge of said base sheet across from said side walls in said opened rear wall and pleated in the corners thereof, said liner constituting a substantially rectangular liquid impervious tub.

* * * * *